US011254890B2

(12) United States Patent
Maruyama et al.

(10) Patent No.: US 11,254,890 B2
(45) Date of Patent: Feb. 22, 2022

(54) LUBRICANT COMPOSITION

(71) Applicants: Toyota Jidosha Kabushiki Kaisha, Aichi (JP); Shell Lubricants Japan K.K., Tokyo (JP)

(72) Inventors: Ryuji Maruyama, Tokyo (JP); Kenji Ohara, Tokyo (JP); Keiichi Moriki, Tokyo (JP); Mitsuhiro Nagakari, Tokyo (JP); Misato Kishi, Aichi (JP); Kotaro Hiraga, Aichi (JP); Takatoshi Shinyoshi, Aichi (JP)

(73) Assignees: TOYOTA JIDOSHA KABUSHIKI KAISHA, Aichi (JP); SHELL LUBRICANTS JAPAN K.K., Tokyo (JP)

( * ) Notice: Subject to any disclaimer, the term of this patent is extended or adjusted under 35 U.S.C. 154(b) by 0 days.

(21) Appl. No.: 17/050,813

(22) PCT Filed: Apr. 18, 2019

(86) PCT No.: PCT/JP2019/016584

§ 371 (c)(1),
(2) Date: Oct. 26, 2020

(87) PCT Pub. No.: WO2019/208373

PCT Pub. Date: Oct. 31, 2019

(65) Prior Publication Data

US 2021/0054299 A1 Feb. 25, 2021

(30) Foreign Application Priority Data

Apr. 26, 2018 (JP) ..... JP2018084795

(51) Int. Cl.

| | |
|---|---|
| ***C10M 111/04*** | (2006.01) |
| ***C10M 105/24*** | (2006.01) |
| ***C10M 105/40*** | (2006.01) |
| ***C10M 107/02*** | (2006.01) |
| ***C10M 107/06*** | (2006.01) |
| *C10N 20/02* | (2006.01) |
| *C10N 30/02* | (2006.01) |
| *C10N 40/04* | (2006.01) |

(52) U.S. Cl.

CPC ..... *C10M 111/04* (2013.01); *C10M 105/24* (2013.01); *C10M 105/40* (2013.01); *C10M 107/02* (2013.01); *C10M 107/06* (2013.01); *C10M 2205/0245* (2013.01); *C10M 2205/173* (2013.01); *C10M 2207/126* (2013.01); *C10M 2207/2835* (2013.01); *C10N 2020/02* (2013.01); *C10N 2030/02* (2013.01); *C10N 2040/04* (2013.01)

(58) Field of Classification Search

CPC ..... C10M 169/04; C10M 105/04; C10M 105/32; C10M 107/02; C10M 129/26; C10M 129/76; C10N 2040/04; C10N 2020/02

See application file for complete search history.

(56) References Cited

U.S. PATENT DOCUMENTS

| | | | | |
|---|---|---|---|---|
| 2008/0300155 | A1 | 12/2008 | Buitrago | |
| 2010/0087348 | A1* | 4/2010 | Moriki | C10M 111/04 508/499 |
| 2015/0119305 | A1* | 4/2015 | Nagakari | C10M 145/14 508/512 |
| 2020/0263105 | A1 | 8/2020 | Kamei | |

FOREIGN PATENT DOCUMENTS

| | | | |
|---|---|---|---|
| JP | 2004-323850 | A | 11/2004 |
| JP | 2005-343972 | A | 12/2005 |
| JP | 2007-100792 | A | 4/2007 |
| JP | 2008-179780 | A | 8/2008 |
| JP | 2012-12536 | A | 1/2012 |
| JP | 2014-98090 | A | 5/2014 |
| JP | 2017-115038 | A | 6/2017 |
| JP | 2017-119748 | A | 7/2017 |

OTHER PUBLICATIONS

International Search Report and Written Opinion Box V of corresponding PCT Application No. PCT/JP2019/016584.

Form PCT/IPEA/409, International Preliminary Report on Patentability Box V of corresponding PCT Application No. PCT/JP2019/016584.

* cited by examiner

*Primary Examiner* — Vishal V Vasisth

(74) *Attorney, Agent, or Firm* — Wood, Phillips, Katz, Clark & Mortimer

(57) ABSTRACT

The purpose of the present invention is to provide a lubricant composition which can be applied as a gear oil for a high-output and high-speed gear mechanism, and whereby fuel saving as well as further wear resistance in a bearing of a pinion gear can be realized while maintaining excellent durability, seizure resistance, and stability are maintained. A lubricant composition containing a Fischer-Tropsch-derived base oil, a poly alpha-olefin, and an ester compound, and further containing an unsaturated fatty acid and/or a partial ester compound of an unsaturated fatty acid and a polyol, wherein the partial ester compound of an unsaturated fatty acid includes a monoester compound of an unsaturated fatty acid and a polyol in a ratio of 50% by mass with respect to the total amount of the partial ester compound, and the SAE viscosity grade of the lubricant composition is 75W-85 or lower.

3 Claims, No Drawings

LUBRICANT COMPOSITION

This application is a 371 of PCT/JP2019/016584, filed Apr. 18, 2019.

TECHNICAL FIELD

The present invention relates to a lubricant composition, and particularly, the invention relates to a lubricant composition that is used as an automotive gear oil or an automotive hypoid gear oil.

BACKGROUND ART

In recent years, regarding the load-bearing performance required of automotive gear oils, a level of GL-4 to GL-5 as the American Petroleum Institute (API) gear oil type is necessary along with increased output characteristics of automobiles.

Furthermore, automotive gear units that are operated in response to various road conditions should be necessarily assumed to be driven under low-speed conditions in which oil film is not easily formed, while the gear oil temperature increases as a result of heat generation caused by a decrease in the filling amount of gear oil concomitant with size reduction of the units, and oil film breakage that is attributed to a decrease in viscosity also tends to occur easily. Therefore, gear oils are required to have further durability.

For gear oils that are required to have such durability, it has been common to employ gear oil with Society of Automotive Engineers (SAE) viscosity number 90 (13.5 to 18.5 $mm^2/s$ (100° C.)), in order to maintain oil film formation on the gear tooth surface.

However, on the one hand, fuel-saving characteristics are also required, and in order to realize this, stirring resistance needs to be reduced, while in order to cope with this, lowering of viscosity is necessary.

In order to satisfy both of such requirements of maintaining the oil film forming action on the gear tooth surface and of lowering viscosity, when a method of increasing the amount of extreme pressure additives added to a low-viscosity base oil is employed on the basis of conventional techniques, there is a high risk that phosphorus-sulfur-based additives, which are used as extreme pressure additives, may increase the adverse effect of corrosiveness on component parts containing copper components and bring about shortening of the device life. Therefore, an additive composition for gear oil, which reduces such corrosion of copper and copper alloys, has also been proposed (Patent Document 1).

Furthermore, a technology of maintaining the GL-5 level by employing a hydrocarbon-based synthetic oil and an ester-based synthetic oil as the base oil, while attempting lowering of viscosity on the one hand, and achieving both durability and fuel-saving characteristics in a well-balanced manner, has also been proposed (Patent Document 2).

In addition, a technology by which a further enhancement of seizure resistance of a differential gear unit may be realized by using a Fischer-Tropsch-derived base oil, a poly-alpha-olefin, and an ester compound in combination, has also been proposed (Patent Document 3). However, on the other hand, with regard to the deterioration of wear resistance of a bearing caused by lowering of viscosity, it is necessary to cope with the deterioration by limiting the usage load conditions, changing the structure of the bearing, and the like, and complete substitution with a gear unit that requires conventional SAE viscosity number 90 for the low-viscosity oil is difficult.

Regarding the wear of a bearing as described herein, for example, the wear of a tapered roller bearing that supports a pinion gear on the input side of a hypoid gear may be mentioned. It is known that when this bearing wears, the positional relation between the pinion gear and the ring gear may not be properly maintained, and as a result, the durability of the gear is deteriorated (Patent Document 4).

PRIOR ART DOCUMENT

Patent Document

Patent Document 1: JP 2004-323850 A
Patent Document 2: JP 2008-179780 A
Patent Document 3: JP 2017-115038 A
Patent Document 4: JP 2007-100792 A

SUMMARY OF THE INVENTION

Problem to be Solved by the Invention

An object of the present invention is to provide a lubricant composition that may be applied to an automotive gear oil or the like which may realize, in addition to fuel-saving characteristics, further wear resistance of a bearing that supports a pinion gear while maintaining durability, seizure resistance, and stability that are applicable as a gear oil to high-output automobiles and other high-output and high-rotation gear mechanisms.

Means for Solving Problem

In order to achieve the above-described object, the present invention relates to a lubricant composition including a Fischer-Tropsch-derived base oil, a poly-alpha-olefin, and an ester compound, and further including an unsaturated fatty acid and/or a partial ester compound of an unsaturated fatty acid and a polyol, in which the partial ester compound of an unsaturated fatty acid includes a monoester compound of an unsaturated fatty acid and a polyol at a proportion of 50% by mass or more of the total amount of the partial ester compound, and the SAE viscosity grade is 75W-85 or lower.

The Fischer-Tropsch-derived base oil is included at a proportion of 30 to 70% by mass with respect to the total mass of the composition, the poly-alpha-olefin is included at a proportion of 10 to 40% by mass with respect to the total mass of the composition, and the ester compound is included at a proportion of 5 to 20% by mass with respect to the total mass of the composition. The Fischer-Tropsch-derived base oil has a kinematic viscosity at 100° C. of 6 to 10 $mm^2/s$.

The unsaturated fatty acid and/or the partial ester compound of an unsaturated fatty acid are included at a proportion of 0.2 to 2% by mass in total with respect to the total mass of the composition. The unsaturated fatty acid is an unsaturated fatty acid having 10 to 20 carbon atoms.

The lubricant composition has a kinematic viscosity at 100° C. of 11.0 to 13.5 $mm^2/s$, satisfies the level of GL-5 as the API gear oil type, and has a viscosity index of 155 or higher.

Effect of the Invention

According to the present invention, a lubricant composition which may realize, in addition to fuel-saving characteristics, further wear resistance of a bearing that supports a pinion gear while maintaining durability, seizure resistance, and stability that are applicable as a gear oil to high-output automobiles and other high-output and high-rotation gear mechanisms, may be provided. Furthermore, in order for this lubricant composition to be effectively used for automotive gear oils, hypoid gear oils, and the like, it is preferable that the lubricant composition has a kinematic viscosity at 100° C. of 11.0 to 13.5 $mm^2/s$, satisfies the API GL-5 level, and has a viscosity index of 155 or higher.

MODE FOR CARRYING OUT THE INVENTION

In the following description, the present invention will be described in detail.

In order to attempt fuel-saving for a gear mechanism, it is necessary to carry out the fuel-saving mainly by achieving the following three points in a highly balanced manner: (1) reducing the sliding between gear tooth surfaces occurring as a result of contact between metals; (2) reducing the energy required by rotating gears to stir the lubricant; and (3) reducing the sliding friction under high-pressure conditions occurring between gear tooth surfaces, with a lubricant film interposed therebetween.

In order to achieve such a balance, usually, it is conceived to take measures, for the above-described item (1), to attempt lowering of the friction coefficient by effective utilization of the oily agents to be added; for the above-described item (2), to attempt lowering of the viscosity by employing a low-viscosity base oil; and for the above-described item (3), to attempt a decrease in the traction coefficient by selecting a base oil having a small shear force.

Furthermore, in order to enhance the load-bearing capacity, it is necessary: (4) to form a firm metal coating film on the gear tooth surface by using an extreme pressure additive; (5) to form an oil film that interrupts the contact between metals; and the like. Furthermore, retention of this oil film also affects the fatigue life of a bearing.

In order to achieve such fuel-saving characteristics and load-bearing capacity in a well-balanced manner, first, selection of principal constituent materials of the lubricant composition is one of important points. That is, a constituent material that has a low viscosity and low stirring resistance at a low temperature, and has a high viscosity in an extreme pressure state where a high temperature occurs, is preferred.

A material close to such a preferable constituent material is a material having a high viscosity index (VI), in which the temperature-dependent viscosity change is small, and a material having a VI value of 140 or greater, preferably 150 or greater, and particularly preferably 155 or greater, is needed.

In order to increase this VI, a Fischer-Tropsch-derived base oil may be mixed in for use, in addition to the poly-alpha-olefin, particularly a high-viscosity poly-alpha-olefin, and an ester base oil.

Furthermore, for the constituent materials, measurement of the oil film thicknesses and measurement of the traction coefficients were carried out, and in (6) a paraffinic mineral oil, the oil film thickness was about 50 to 230 nm (nanometers), while the traction coefficient was about 0.019 to 0.028; in (7) a naphthenic mineral oil, the oil film thickness was about 100 to 380 nm (nanometers), while the traction coefficient was about 0.03 to 0.044; and in (8) a paraffinic synthetic oil and an ester synthetic oil, the oil film thickness was about 70 to 320 nm (nanometers), while the traction coefficient was about 0.007 to 0.014. From such matters, in order to obtain a low traction, the (8) paraffinic synthetic oil and ester compound (ester synthetic oil) are preferred.

Regarding the (8) paraffinic synthetic oil and ester compound as such, those compounds selected from compounds belonging to the three groups of poly-alpha-olefins, Fischer-Tropsch-derived base oils, and ester compounds may be mentioned. Among these groups, a compound which exhibits the lowest traction coefficient and with which an effect of oiliness may also be obtained, may be an ester compound.

In addition to such increase in the fuel-saving characteristics and load-bearing capacity, in order to improve the fatigue life of differential gear units in automobiles and the like, it is an effective mean to mix and use a Fischer-Tropsch-derived base oil in addition to the poly-alpha-olefin and the ester compound. Furthermore, in order to further improve the wear resistance of a bearing that supports a pinion gear, it is effective to mix and use an unsaturated fatty acid and/or a partial ester compound of an unsaturated fatty acid and a polyol, in addition to the Fischer-Tropsch-derived base oil, the poly-alpha-olefin, and the ester compound.

The various constituent components of the present invention will be described below.

A Fischer-Tropsch-derived base oil, which is component (A-1) of the present invention, is already known in the technical field. The term "Fischer-Tropsch-derived" means that the base oil is a synthesis product of the Fischer-Tropsch method, or a base oil derived from this synthesis product. The Fischer-Tropsch-derived base oil may also be referred to as GTL (Gas to Liquid) base oil. Examples of an appropriate Fischer-Tropsch-derived base oil that may be conveniently used as a base oil in the lubricant composition include the base oils disclosed in EP 0776959, EP 0668342, WO 97/21788, WO 00/15736, WO 00/14188, WO 00/14187, WO 00/14183, WO 00/14179, WO 00/08115, WO 99/41332, EP 1029029, WO 01/18156, and WO 01/57166.

The kinematic viscosity of the Fischer-Tropsch-derived base oil is such that the kinematic viscosity at 100° C. is 3 to 10 $mm^2/s$. When the kinematic viscosity at 100° C. of the Fischer-Tropsch-derived base oil is lower than 3 $mm^2/s$, the amount of evaporation at high temperature is large, the viscosity of the composition increases, and the effect of fuel-saving characteristics is reduced. When the kinematic viscosity at 100° C. of the Fischer-Tropsch-derived base oil is higher than 10 $mm^2/s$, there is a risk that the viscosity at low temperature (−40° C.) may increase, and therefore, it is not desirable.

From the viewpoint of oil film formation, the kinematic viscosity at 100° C. of the Fischer-Tropsch-derived base oil is preferably 6 to 10 $mm^2/s$, and more preferably 6 to 9 $mm^2/s$.

The content of the Fischer-Tropsch-derived base oil is 30 to 70% by mass with respect to the total mass (100% by mass) of the lubricant composition. When the content of the Fischer-Tropsch-derived base oil is less than 30% by mass, a large amount of a high-viscosity (20 to 100 $mm^2/s$) poly-alpha-olefin (PAO) should be used in order to maintain a viscosity of about 7 to 11 $mm^2/s$ at a high temperature of 100° C., and since the ratio of synthetic oil increases, it is not economically efficient. When the content of the Fischer-Tropsch-derived base oil is more than 70% by mass, there is a limit on the blending amount of the high-viscosity poly-alpha-olefin (PAO), and in order to maintain the viscosity index of the composition at 155 or higher while maintaining the product viscosity at 13.5 $mm^2/s$ or less, it is necessary to increase the blending amount of a viscosity index improver. Therefore, it is not economically efficient. The content of the Fischer-Tropsch-derived base oil is preferably 35 to 65% by mass, more preferably 40 to 60% by mass, and even more preferably 50 to 60% by mass, with respect to the total mass of the lubricant composition.

As the Fischer-Tropsch-derived base oil of the present invention, for example, a Fischer-Tropsch-derived base oil that is commercially available from Royal Dutch Shell plc as RISELLA X430 may be mentioned.

The Fischer-Tropsch-derived base oils may be used singly, or two or more kinds thereof may be used in combination.

A poly-alpha-olefin (PAO), which is component (A-2) of the present invention, includes polymerization products of various alpha-olefins, or hydrides thereof. Any arbitrary alpha-olefins may be used; however, examples include ethylene, propylene, butene, and α-olefins having 5 to 19 carbon atoms.

Upon the production of a poly-alpha-olefin, one kind of the above-described alpha-olefins may be used alone, or two or more kinds thereof may be used in combination.

The alpha-olefin is preferably ethylene and propylene, and a combination of ethylene and propylene is more preferred because the combination exhibits a high thickening effect.

Regarding this poly-alpha-olefin, polymers having various viscosities are obtained depending on the type, degree of polymerization, and the like of the alpha-olefin to be used; however, a high-viscosity poly-alpha-olefin is preferably used.

For the poly-alpha-olefin, a high-viscosity poly-alpha-olefin having a kinematic viscosity at 100° C. of 20 to 100 $mm^2/s$ is used. When the kinematic viscosity at 100° C. of the poly-alpha-olefin is lower than 20 $mm^2/s$, it is not preferable because the viscosity index increasing effect of the lubricant composition is low. When the kinematic viscosity at 100° C. of the poly-alpha-olefin is higher than 100 $mm^2/s$, it is not preferable because the oil film thickness of the lubricant composition is thin.

Regarding the poly-alpha-olefin, the kinematic viscosity at 100° C. is preferably 25 to 70 $mm^2/s$, and more preferably 30 to 50 $mm^2/s$.

The content of the poly-alpha-olefin is 10 to 40% by mass with respect to the total mass of the lubricant composition. When the content of the poly-alpha-olefin is less than 10% by mass, it is not preferable because the viscosity of the lubricant composition is lowered, and the oil film thickness becomes thin. When the content of the poly-alpha-olefin is more than 40% by mass, it is not preferable because the viscosity of the lubricant composition increases, and the fuel-saving characteristics are deteriorated. The content of the poly-alpha-olefin is preferably 15 to 35% by mass, more preferably 15 to 30% by mass, even more preferably 15 to 25% by mass, and most preferably 15 to 20% by mass.

Regarding the poly-alpha-olefin of the present invention, for example, a poly-alpha-olefin that is commercially available from The Lubrizol Corporation as LUCANT HC40.

The poly-alpha-olefin may be used singly, or two or more kinds thereof may be used in combination.

An ester compound, which is component (A-3) of the present invention, may be a polyol ester.

The polyol ester that may be mentioned as an example of the component (A-3) includes a fatty acid ester obtained from at least one selected from the group consisting of a dihydric to tetrahydric polyol and an ethylene oxide adduct thereof, and a fatty acid having 4 to 12 carbon atoms. In the following description, the dihydric to tetrahydric polyol and an ethylene oxide adduct thereof will be described in sequence.

Specific examples of the polyol include, first, as diols, ethylene glycol, 1,3-propanediol, propylene glycol, 1,4-butanediol, 1,2-butanediol, 2-methyl-1,3-propanediol, 1,5-pentanediol, neopentyl glycol, 1,6-hexanediol, 2-ethyl-2-methyl-1,3-propanediol, 1,7-heptanediol, 2-methyl-2-propyl-1,3-propanediol, 2,2-diethyl-1,3-propanediol, 1,8-octanediol, 1,9-nonanediol, 1,10-decanediol, 1,11-undecanediol, and 1,12-dodecanediol. However, since diester-based base oils affect sealing materials, which include polyacrylate rubber (PAR), care must be taken.

Specific examples of a polyol having three or more hydroxy groups include polyhydric alcohols such as trimethylolethane, trimethylolpropane, trimethylolbutane, di-(trimethylolpropane), tri-(trimethylolpropane), pentaerythritol, di-(pentaerythritol), tri-(pentaerythritol), glycerol, polyglycerol (dimer to eicosamer of glycerol), 1,3,5-pentanetriol, sorbitol, sorbitan, a sorbitol glycerol condensate, adonitol, arabitol, xylitol, and mannitol; sugars such as xylose, arabinose, ribose, rhamnose, glucose, fructose, galactose, mannose, sorbose, cellobiose, maltose, isomaltose, trehalose, sucrose, raffinose, gentianose, and melezitose; partial etherification products thereof, and methyl glucoside (glycoside).

Among these, a polyol having three hydroxy groups is preferred because thermal oxidation stability, additive solubility, and low-temperature fluidity are satisfactorily balanced, and above all, trimethylolpropane is most preferred.

The polyol ethylene oxide adduct is obtained by adding ethylene oxide to the above-described polyol at a proportion of 1 to 4 mol, and preferably 1 to 2 mol. Preferably, the polyol ethylene oxide adduct is ethylene oxide adducts of neopentyl glycol, trimethylolpropane, and pentaerythritol. When the number of added moles is more than 4 mol, heat resistance of the fatty acid ester thus obtained may be deteriorated.

The dihydric to tetrahydric polyol and an ethylene oxide adduct thereof may be used singly, or two or more kinds thereof may be used as a mixture.

The fatty acid used as a raw material for the ester compound, which is the component (A-3) of the present invention, is a fatty acid having 4 to 12 carbon atoms, preferably a fatty acid having 6 to 12 carbon atoms, and more preferably a fatty acid having 8 to 10 carbon atoms, as described above. In a case in which a fatty acid having 3 or fewer carbon atoms is used, the expected effect of adding an ester may not be satisfying. On the other hand, in a case in which a fatty acid having more than 12 carbon atoms is used, the low-temperature fluidity of the resulting ester may be deteriorated.

The above-described fatty acid is not particularly limited, and a saturated fatty acid, an unsaturated fatty acid, a mixture of these, and the like may be used. Furthermore, these fatty acids may be linear fatty acids, branched fatty acids, or mixtures of these. Examples of the saturated fatty acid include saturated fatty acids containing a linear saturated fatty acid at a proportion of 50 mol % or more, and saturated fatty acids containing a branched saturated fatty acid at a proportion of 50 mol % or more. From the viewpoints that the resulting fatty acid ester has stability at high temperature, and has an appropriate viscosity as a lubricant and has a high viscosity index or the like, a saturated fatty acid is preferred, and in particular, a linear saturated fatty acid is preferred.

Examples of the linear saturated fatty acid include butyric acid, pentanoic acid, caproic acid, heptanoic acid, caprylic acid, pelargonic acid, capric acid, undecanoic acid, and lauric acid.

Among these, caprylic acid and capric acid are preferred because they exhibit the most appropriate viscosities, and a mixture of caprylic acid and capric acid is more preferred.

The ester compound, which is the component (A-3) of the present invention, is obtained by reacting at least one selected from the group consisting of the above-described dihydric to tetrahydric polyol and ethylene oxide adducts thereof, with a fatty acid at any arbitrary proportions. Preferably, the ester compound is obtained by reacting the fatty acid at a proportion of about 2 to 6 mol, and more preferably about 2.1 to 5 mol, with 1 mol of this polyol and an adduct thereof.

The ester compound, which is the component (A-3) of the present invention, is preferably a complete ester compound in which the alcohol moiety has been completely esterified, and for example, a complete ester compound of a diol, or a complete ester compound of a trihydric or higher-hydric polyol.

The ester compound, which is the component (A-3) of the present invention, is preferably a polyol ester, and a triol ester is more preferred. A most preferred ester compound is an ester compound of trimethylolpropane, a linear carboxylic acid having 8 carbon atoms, and a linear carboxylic acid having 10 carbon atoms.

The ester compound, which is the component (A-3) of the present invention, is an ester compound having a kinematic viscosity at 100° C. of 3 to 6 $mm^2/s$. When the ester compound has a kinematic viscosity at 100° C. of lower than 3 $mm^2/s$, it is not preferable because the amount of evaporation loss at high temperature is large. When the kinematic viscosity at 100° C. is higher than 6 $mm^2/s$, it is not preferable because low-temperature fluidity is deteriorated. The kinematic viscosity at 100° C. of the ester compound of the present invention is preferably 4 to 5 $mm^2/s$.

Regarding the content of the ester compound, which is the component (A-3) of the present invention, the ester compound is incorporated at a proportion of 5 to 20% by mass with respect to the total mass of the lubricant composition. When the content of the ester compound is less than 5% by mass, it is not preferable because the solubility of additives is lowered. When the content of the ester compound is more than 20% by mass, it is not preferable from the viewpoints that there is a possibility that the ester compound may be hydrolyzed, and that the occurrence of competitive adsorption to the metal surface with an extreme pressure additive is observed. The content of the ester compound of the present invention is preferably 7 to 15% by mass, and more preferably 8 to 12% by mass.

Regarding the ester compound as the component (A-3) of the present invention, for example, an ester compound that is commercially available from Croda International plc as PRIOLUBE 3970 may be mentioned.

The ester compounds may be used singly, or two or more kinds thereof may be used in combination. Furthermore, a diester may have a low kinematic viscosity and may make the swellability of the sealing excessively high.

An unsaturated fatty acid, which is component (B-1) of the present invention, and a partial ester compound of an unsaturated fatty acid and a polyol, which is component (B-2), will be described. In the present invention, any one or both of the (B-1) unsaturated fatty acid and the (B-2) partial ester compound of an unsaturated fatty acid and a polyol are included in the lubricant composition. The partial ester compound of an unsaturated fatty acid and a polyol of the present invention includes a monoester compound of an unsaturated fatty acid and a polyol at a proportion of 50% by mass or more with respect to 100% by mass of the total amount of the partial ester compound.

The unsaturated fatty acid, which is the component (B-1) of the present invention, is practically an unsaturated fatty acid having 10 to 20 carbon atoms. When the number of carbon atoms of the unsaturated fatty acid is less than 10, it is not preferable because the unsaturated fatty acid affects the foul odor and corrosion of the manufactured product, while when the number of carbon atoms is more than 20, it is not preferable because the low-temperature characteristics are deteriorated. Even more preferably, the unsaturated fatty acid is an unsaturated fatty acid having 16 to 20 carbon atoms. Examples include myristoleic acid, palmitoleic acid, sapienic acid, oleic acid, elaidic acid, vaccenic acid, gadoleic acid, eicosenoic acid, linoleic acid, eicosadienoic acid, α-linolenic acid, γ-linolenic acid, pinolenic acid, α-eleostearic acid, β-eleostearic acid, mead acid, dihomo-γ-linolenic acid, eicosatrienoic acid, stearidonic acid, arachidonic acid, eicosatetraenoic acid, adrenic acid, bosseopentaenoic acid, and eicosapentaenoic acid. There is no particular limitation on the number of unsaturations in a molecule of an unsaturated fatty acid; however, from the viewpoint of oxidation stability, it is preferable that the number of unsaturations is 1. Examples include palmitoleic acid, oleic acid, elaidic acid, gadoleic acid, and eicosenoic acid, and in particular, oleic acid is preferred.

The unsaturated fatty acid in the partial ester compound of an unsaturated fatty acid and a polyol, which is component (B-2) of the present invention, is substantially the same as the above-described (B-1) unsaturated fatty acid, and practically, the unsaturated acid is an unsaturated fatty acid having 10 to 20 carbon atoms.

The polyol in the (B-2) partial ester compound of an unsaturated fatty acid and a polyol of the present invention is not particularly limited as long as it is a dihydric or higher-hydric polyol; however, a trihydric or higher-hydric polyol is preferred. Specific examples include polyhydric alcohols such as trimethylolethane, trimethylolpropane, trimethylolbutane, di-(trimethylolpropane), tri-(trimethylolpropane), pentaerythritol, di-(pentaerythritol), tri-(pentaerythritol), glycerol, polyglycerol (dimer to eicosamer of glycerol), 1,3,5-pentanetriol, sorbitol, sorbitan, a sorbitol glycerol condensate, adonitol, arabitol, xylitol, and mannitol; sugars such as xylose, arabinose, ribose, rhamnose, glucose, fructose, galactose, mannose, sorbose, cellobiose, maltose, isomaltose, trehalose, sucrose, raffinose, gentianose, and melezitose; and methyl glucoside.

Among these, a trihydric or tetrahydric polyol is more preferred from the viewpoint of the solubility in the lubricant as a reaction product with an unsaturated fatty acid. Specific examples include glycerol, trimethylolpropane, and pentaerythritol. Among these, trimethylolpropane and glycerol are particularly preferred.

The (B-2) partial ester compound of an unsaturated fatty acid and a polyol of the present invention is a compound in which the polyol is not completely esterified. Specifically, a monoester compound of a polyol; in a case in which the polyol is a trihydric polyol, a diester compound of a polyol; and in a case in which the polyol is a tetrahydric polyol, a diester compound of a polyol, a triester compound of a polyol, or the like is included.

The (B-2) partial ester compound of an unsaturated fatty acid and a polyol of the present invention is preferably a monoester compound from the viewpoints of the affinity to a metal surface and the solubility in the lubricant, and in order to exhibit predetermined performance. However, in a case in which the partial ester compound includes a partial ester compound of a diester or higher-ester compound, the ratio X/Y of the partial ester of a diester or higher-ester compound (content X %) and the monoester compound (content Y %) is 1 or less, more preferably 1/10 or less, and particularly preferably 1/20 or less.

Regarding the (B-2) partial ester compound of an unsaturated fatty acid and a polyol of the present invention, glycerol monooleate, trimethylolpropane monooleate, and pentaerythritol monooleate are particularly preferred.

Regarding the (B-2) partial ester compound of an unsaturated fatty acid and a polyol of the present invention, a commercially available product may be purchased, or the compound may be prepared. Examples of a commercially available product include products that are commercially available from Kao Corporation as EXCEPARL PE-MO and EMASOL MO-50.

The sum of the blending amount of the unsaturated fatty acid, which is the component (B-1) of the present invention, and/or the partial ester compound of an unsaturated fatty acid and a polyol, which is the component (B-2), must be 0.2% by mass or more with respect to the total mass of the lubricant composition; however, usually, the unsaturated fatty acid and the partial ester compound are incorporated at a proportion in the range of 0.2 to 2% by mass. When the blending amount is less than 0.2% by mass, it is not preferable because an effect of improving wear resistance is not obtained. When the blending amount is more than 2.0% by mass, it is not preferable because a decrease in oxidation stability may be brought about, and a decrease in solubility may be brought about. In order to exhibit the maximum performance through addition of the component, it is particularly preferable to incorporate the unsaturated fatty acid and/or the partial ester compound at a proportion in the range of 0.5 to 1.0% by mass.

In addition to the above-described components, in order to further enhance the performance, various additives may be appropriately used as necessary. Examples of these include an extreme pressure additive, a viscosity index improver, an oxidation inhibitor, a metal deactivator, an oiliness enhancer, a defoaming agent, a pour point depressant, a detergent dispersant, a rust preventive agent, a demulsifier, and other known lubricant additives.

As the extreme pressure additive, a sulfur-based extreme pressure additive, a phosphorus compound, or a combination of these, a phosphorothionate, or the like may be used.

As the sulfur-based extreme pressure additive, a hydrocarbon sulfide represented by the following General Formula (1), sulfurized terpene, sulfurized oils and fats, which are reaction products of oils and fats with sulfur, and the like are used.

(Chemical Formula 1)

$$R_1\text{-}Sy\text{-}(R_3\text{-}Sy)n\text{-}R_2 \quad (1)$$

In the above-described General Formula (1), $R_1$ and $R_2$ each represent a monovalent hydrocarbon group and may be identical with or different from each other; $R_3$ represents a divalent hydrocarbon group; y represents an integer of 1 or greater, and preferably 1 to 8; the respective y in the repeating units may be identical or different numbers; and n represents an integer of 0 or 1 or greater.

Regarding the monovalent hydrocarbon group for $R_1$ and $R_2$, a linear or branched, saturated or unsaturated aliphatic hydrocarbon group having 2 to 20 carbon atoms (for example, an alkyl group or an alkenyl group), and an aromatic hydrocarbon group having 6 to 26 carbon atoms may be mentioned, and specific examples include an ethyl group, a propyl group, a butyl group, a nonyl group, a dodecyl group, a propenyl group, a butenyl group, a benzyl group, a phenyl group, a tolyl group, and a hexylphenyl group.

Also regarding the divalent hydrocarbon group for $R_3$, a linear or branched, saturated or unsaturated aliphatic hydrocarbon group having 2 to 20 carbon atoms, and an aromatic hydrocarbon group having 6 to 26 carbon atoms may be mentioned, and specific examples include an ethylene group, a propylene group, a butylene group, and a phenylene group.

Representative examples of the hydrocarbon sulfide represented by the above-described General Formula (1) include a sulfur olefin and a polysulfide compound represented by General Formula (2).

(Chemical Formula 2)

$$R_1\text{-}Sy\text{-}R_2 \quad (2)$$

In the General Formula (2), $R_1$ and $R_2$ are the same as those in the above-described General Formula (1); and y represents an integer of 2 or greater.

Specific examples include diisobutyl disulfide, dioctyl polysulfide, di-tertiary-nonyl polysulfide, di-tertiary-butyl polysulfide, di-tertiary-benzyl polysulfide, and sulfurized olefins obtained by sulfurizing olefins such as polyisobutylene and terpenes with a sulfurizing agent such as sulfur.

Specific examples of the phosphorothionate include tributyl phosphorothionate, tripentyl phosphorothionate, trihexyl phosphorothionate, triheptyl phosphorothionate, trioctyl phosphorothionate, trinonyl phosphorothionate, tridecyl phosphorothionate, triundecyl phosphorothionate, tridodecyl phosphorothionate, tritridecyl phosphorothionate, tritetradecyl phosphorothionate, tripentadecyl phosphorothionate, trihexadecyl phosphorothionate, triheptadecyl phosphorothionate, trioctadecyl phosphorothionate, trioleyl phosphorothionate, triphenyl phosphorothionate, tricresyl phosphorothionate, trixylenyl phosphorothionate, cresyl diphenyl phosphorothionate, xylenyl diphenyl phosphorothionate, tris(n-propylphenyl) phosphorothionate, tris(isopropylphenyl) phosphorothionate, tris(n-butylphenyl) phosphorothionate, tris(isobutylphenyl) phosphorothionate, tris (s-butylphenyl) phosphorothionate, and tris(t-butylphenyl) phosphorothionate.

Furthermore, in order to impart extreme pressure characteristics and wear resistance, a phosphorus compound may also be used. Examples of the phosphorus compound appropriate for the present invention include a phosphoric acid ester, an acidic phosphoric acid ester, an amine salt of an acidic phosphoric acid ester, a chlorinated phosphoric acid ester, a phosphorous acid ester, a phosphorothionate, zinc dithiophosphate, an ester of dithiophosphoric acid and an alkanol or a polyether type alcohol, or a derivative of the ester, a phosphorus-containing carboxylic acid, and a phosphorus-containing carboxylic acid ester.

Examples of the phosphoric acid ester include tributyl phosphate, tripentyl phosphate, trihexyl phosphate, triheptyl phosphate, trioctyl phosphate, trinonyl phosphate, tridecyl phosphate, triundecyl phosphate, tridodecyl phosphate, tritridecyl phosphate, tritetradecyl phosphate, tripentadecyl phosphate, trihexadecyl phosphate, triheptadecyl phosphate, trioctadecyl phosphate, trioleyl phosphate, triphenyl phosphate, tris(iso-propylphenyl) phosphate, triallyl phosphate, tricresyl phosphate, trixylenyl phosphate, cresyl diphenyl phosphate, and xylenyl diphenyl phosphate.

Specific examples of the acidic phosphoric acid ester include monobutyl acid phosphate, monopentyl acid phosphate, monohexyl acid phosphate, monoheptyl acid phosphate, monooctyl acid phosphate, monononyl acid phosphate, monodecyl acid phosphate, monoundecyl acid phosphate, monododecyl acid phosphate, monotridecyl acid phosphate, monotetradecyl acid phosphate, monopentadecyl acid phosphate, monohexadecyl acid phosphate, monoheptadecyl acid phosphate, monooctadecyl acid phosphate, monooleyl acid phosphate, dibutyl acid phosphate, dipentyl acid phosphate, dihexyl acid phosphate, diheptyl acid phosphate, dioctyl acid phosphate, dinonyl acid phosphate, didecyl acid phosphate, diundecyl acid phosphate, didodecyl acid phosphate, ditridecyl acid phosphate, ditetradecyl acid phosphate, dipentadecyl acid phosphate, dihexadecyl acid phosphate, diheptadecyl acid phosphate, dioctadecyl acid phosphate, and dioleyl acid phosphate.

Examples of the amine salt of an acidic phosphoric acid ester include salts of the above-described acidic phosphoric acid ester with amines such as methylamine, ethylamine, propylamine, butylamine, pentylamine, hexylamine, heptylamine, octylamine, dimethylamine, diethylamine, dipropylamine, dibutylamine, dipentylamine, dihexylamine, diheptylamine, dioctylamine, trimethylamine, triethylamine, tripropylamine, tributylamine, tripentylamine, trihexylamine, triheptylamine, and trioctylamine.

Examples of the phosphorous acid ester include dibutyl phosphite, dipentyl phosphite, dihexyl phosphite, diheptyl phosphite, dioctyl phosphite, dinonyl phosphite, didecyl phosphite, diundecyl phosphite, didodecyl phosphite, dioleyl phosphite, diphenyl phosphite, dicresyl phosphite, tributyl phosphite, tripentyl phosphite, trihexyl phosphite, triheptyl phosphite, trioctyl phosphite, trinonyl phosphite, tridecyl phosphite, triundecyl phosphite, tridodecyl phosphite, trioleyl phosphite, triphenyl phosphite, and tricresyl phosphite.

The extreme pressure additive may be used singly or as an adequate mixture. This extreme pressure additive may be used such that the amount of addition of the extreme pressure additive becomes 3 to 20% by mass, and preferably 5 to 15% by mass, with respect to the total mass of the lubricant composition. Furthermore, the additive is selected, and an extreme pressure additive package, which is a mixture of a sulfur-based compound and a phosphorus-based compound, is suitable in view of the product management of the manufactured product. Examples include ANGLAMOL 99, 98A, and 6043 of The Lubrizol Corporation, and the respective series of HiTEC 340 and 380 of Afton Chemical.

In order to enhance the viscosity characteristics and low-temperature fluidity for the lubricant composition of the present invention, a viscosity index improver and a pour point depressant may be added.

Examples of the viscosity index improver include non-dispersion type viscosity index improvers, such as polymethacrylates and olefin polymers such as an ethylene-propylene copolymer, a styrene-diene copolymer, polyisobutylene, and polystyrene; and dispersion type viscosity index improvers obtained by copolymerizing these polymers with nitrogen-containing monomer. The amount of addition thereof may be in the range of 0.5 to 15% by mass, and preferably in the range of 1 to 10% by mass, with respect to the total mass of the composition.

Furthermore, examples of the pour point depressant include methacrylate-based polymers. The amount of addition thereof that may be used is in the range of 0.01 to 5% by mass with respect to the total mass of the lubricant composition.

Regarding the oxidation inhibitor to be used for the present invention, an agent that is used for lubricants is practically preferred, and examples include a phenolic oxidation inhibitor, an amine-based oxidation inhibitor, and a sulfur-based oxidation inhibitor. These oxidation inhibitors may be used singly or in combination of a plurality of compounds, at a proportion in the range of 0.01 to 5% by mass with respect to the total mass of the lubricant composition.

Examples of the metal deactivator that may be used in combination with the composition of the present invention include benzotriazole; benzotriazole derivatives, including 4-alkyl-benzotriazoles such as 4-methyl-benzotriazole and 4-ethyl-benzotriazole; 5-alkyl-benzotriazoles such as 5-methyl-benzotriazole and 5-ethyl-benzotriazole; 1-alkyl-benzotriazoles such as 1-dioctylaminomethyl-2,3-benzotriazole; 1-alkyl-tolutriazoles such as 1-dioctylaminomethyl-2,3-tolutriazole; and benzimidazole, benzimidazole derivatives, including 2-(alkyldithio)-benzimidazoles such as 2-(octyldithio)-benzimidazole, 2-(decyldithio)-benzimidazole, and 2-(dodecyldithio)-benzimidazole; and 2-(alkyldithio)-toluimidazoles such as 2-(octyldithio)-toluimidazole, 2-(decyldithio)-toluimidazole, and 2-(dodecyldithio)-toluimidazole.

These metal deactivators may be used singly or in combination of a plurality of compounds at a proportion in the range of 0.01 to 0.5% by mass with respect to the total mass of the lubricant composition.

In order to impart defoaming properties to the lubricant composition of the present invention, a defoaming agent may be added. Examples of a defoaming agent appropriate for the present invention include organosilicates such as dimethylpolysiloxane, diethyl silicate, and fluorosilicone; and non-silicon-based defoaming agents such as a polyalkyl acrylate. Regarding the amount of addition thereof, the defoaming agents may be used singly or in combination of a plurality of the compounds at a proportion in the range of 0.0001 to 0.1% by mass with respect to the total mass of the lubricant composition.

As a demulsifier appropriate for the present invention, known agents that are usually used as lubricant additives may be mentioned. Regarding the amount of addition thereof, the demulsifier may be used at a proportion in the range of 0.0005 to 0.5% by mass with respect to the total mass of the lubricant composition.

The lubricant composition of the present invention may be prepared by mixing a Fischer-Tropsch-derived base oil, a poly-alpha-olefin, and an ester compound, and any one kind, two or more kinds of an unsaturated fatty acid and a partial ester compound of an unsaturated fatty acid, as well as optional additives, in any arbitrary order.

The lubricant composition of the present invention has a relatively low viscosity, and the viscosity is 75W-85 or lower, and specifically 75W-80 or 75W, in the society of automotive engineers (SAE) viscosity grade. With regard to the lubricant composition of the present invention, the kinematic viscosity at 100° C. is 4 $mm^2/s$ or higher, preferably 7 $mm^2/s$ or higher and lower than 13.5 $mm^2/s$, more preferably 11 $mm^2/s$ or higher and lower than 13.5 $mm^2/s$, and particularly preferably 11 $mm^2/s$ or higher and 12 $mm^2/s$ or lower. Furthermore, with regard to the lubricant composition of the present invention, the viscosity at a low temperature (−40° C.) measured according to ASTM D2983 is lower than 80 Pa·s, and particularly lower than 55 Pa·s, and a balance between the fuel-saving characteristics at low temperature and lubricity may be realized. Furthermore, the lubricant composition of the present invention may be expected to have a sufficient effect particularly in terms of the bearing wear preventive property that will be described below, even in a lubricant of a viscosity grade other than the above-described SAE viscosity grade.

Furthermore, the lubricant composition of the present invention has a viscosity index of 155 or higher so that a balance between fuel-saving characteristics and lubricity may be promoted.

In order to check the load-bearing capacity of the lubricant composition of the present invention, with reference to the differential part damage testing method using an actual machine differential gear as described in JP 2017-115038 A, an experiment of changing to more strict conditions, in which the differential speed of rotation was increased, was carried out. The lubricant composition of the present invention is such that the API gear oil type is GL-5 level, and the lubricant composition may achieve a damage limit torque equal to or higher than that of a commercially available high-viscosity gear oil having a SAE viscosity grade of 85W-90, and is able to realize satisfactory seizure resistance of a differential gear unit.

The lubricant composition of the present invention may further realize the wear resistance of a bearing of a pinion gear for an actual machine differential gear.

The wear resistance of the bearing of a pinion gear may be approximately determined by measuring the average value (mm) of the wear scar diameter in a shell four-ball test carried out with reference to ASTM D4172. In the shell four-ball test as described herein, the average value (mm) of the wear scar diameter is measured under the conditions of both of operation at a spindle speed of 1,500 rotations per minute, a load of 98 N, and an oil temperature of 135° C. for 60 minutes (condition 1) and operation at a spindle speed of 1,500 rotations per minute, a load of 98 N, and an oil temperature of 160° C. for 60 minutes (condition 2).

The lubricant composition of the present invention gives an average value of the wear scar diameter of 0.23 mm or less and may realize satisfactory wear resistance under any of the conditions (condition 1 and condition 2).

In the present invention, when the lubricant composition, with which satisfactory results were obtained in the above-described shell four-ball test, was subjected to an actual machine bearing pattern durability test by assuming a wide range of usage conditions for a differential gear mounted in an actual vehicle, it was verified that wear does not occur in the bearing. Thus, the lubricant composition may realize satisfactory wear resistance (wear preventive property) of the bearing of a pinion gear even in an actual machine.

The lubricant composition of the present invention may be applied as a gear oil to high-output automobiles and other high-output and high-rotation gear mechanisms. Particularly, the lubricant composition is such that the gear oil type is the API GL-5 level, and the lubricant composition may realize further wear resistance of the bearing of a pinion gear in addition to fuel-saving characteristics while maintaining excellent durability, seizure resistance, and stability, and may be effectively applied to automotive gear oils, hypoid gear oils, and the like.

EXAMPLES

Hereinafter, the present invention will be specifically described by way of Examples, Comparative Examples, and Reference Examples; however, the present invention is not intended to be limited to these Examples only.

Upon the preparation of Examples and Comparative Examples, the following constituent materials were prepared.

1. Fischer-Tropsch-derived base oil (GTL base oil): A-1

(1-1) Fischer-Tropsch-derived base oil having a kinematic viscosity at 100° C. of 3.8 $mm^2/s$ (1-2) Fischer-Tropsch-derived base oil having a kinematic viscosity at 100° C. of 7.8 $mm^2/s$ 2. Poly-alpha-olefin (PAO): A-2

(2-1) Low-viscosity poly-alpha-olefin having a kinematic viscosity at 100° C. of 3.91 $mm^2/s$ (2-2) Poly-alpha-olefin consisting of a high-viscosity ethylene-propylene copolymer having a kinematic viscosity at 100° C. of 38.6 $mm^2/s$ 3. Ester base oil: A-3

(3-1) TMP (ester of trimethylolpropane, a linear carboxylic acid having 8 carbon atoms, and a linear carboxylic acid having 10 carbon atoms): ester base oil TMP having a kinematic viscosity at 100° C. of 4.42 $mm^2/s$ (3-2) DIDA (diisodecyl adipate): diester base oil having a kinematic viscosity at 100° C. of 3.7 $mm^2/s$ 4. Unsaturated fatty acid: B-1

Oleic acid: reagent oleic acid, purity 90% or higher

5. Saturated fatty acid

Stearic acid: reagent stearic acid, purity 90% or higher

6. Partial ester of unsaturated fatty acid: B-2

(6-1) Glycerol monooleate: product obtained by purifying a commercially available glycerol monooleate having a monooleate ratio of 90% or more into a product having a monooleate ratio of 95%

(6-2) Glycerol dioleate: product obtained by separating and collecting glycerol dioleate using a commercially available glycerol monooleate (monooleate 45% or more, dioleate 25% or more, and trioleate 10% or more) as a raw material, and adjusting the dioleate ratio to 95% or more.

(6-3) Pentaerythritol monooleate: industrial pentaerythritol monooleate having a monooleate ratio of 80% or more.

(6-4) Trimethylolpropane monooleate: industrial trimethylolpropane monooleate having a monooleate ratio of 80% or more.

7. Viscosity index improver: polymethacrylate having a mass average molecular weight of 10,000 to 100,000; a polymer having a kinematic viscosity at 100° C. of about 260 $mm^2/s$.

8. Sulfur-phosphorus-based extreme pressure agent: an extreme pressure agent package (GL-5 additive package) obtained by blending an olefin sulfide, a phosphoric acid ester amine salt, and the like, the agent package having a phosphorus content of about 1.4% and a sulfur content of about 22%.

Examples and Comparative Examples

Lubricant compositions of Examples 1 to 6 and Comparative Examples 1 to 6 were prepared on the basis of the compositions described in Table 1 using the above-described constituent materials.

Reference Example

Toyota genuine hypoid gear oil SX was obtained as a commercially available gear oil for passenger cars, and this was designated as Reference Example 1. This gear oil for passenger cars is such that the API gear oil type is GL-5 level and satisfies the condition of a SAE viscosity grade of 85W-90.

For an evaluation of the performance of the lubricant compositions of Examples and Comparative Examples, the following test was carried out.

(Low-Temperature Viscosity Measurement)

The viscosity at −40° C. was measured according to ASTM D2983.

The upper limit of viscosity of SAE viscosity number 75W is 150 Pa·s; however, particularly for the fuel-saving characteristics at low temperature, a viscosity of less than 80 Pa·s was considered acceptable.

(Preliminary Examination of Bearing Wear Preventive Property)

For the lubricant composition of the present invention, a shell four-ball test was carried out under two conditions with reference to ASTM D4172, assuming the load and temperature at the worn portion under the particular pattern conditions of a bearing assuming a pattern durability test of an actual machine tapered roller bearing, and a comparison of the wear resistance of the lubricant compositions of Examples 1 to 6, Comparative Examples 1 to 6, and Reference Example 1 was carried out.

(Condition 1): With reference to ASTM D4172, operation was conducted at a spindle speed of 1,500 rotations per minute, a load of 98 N, and an oil temperature of 135° C. for 60 minutes. The wear scar diameter of the steel balls after the test was measured.

(Condition 2): With reference to ASTM D4172, operation was conducted at a spindle speed of 1,500 rotations per minute, a load of 98 N, and an oil temperature of 160° C. for 60 minutes. The wear scar diameter of the steel balls after the test was measured.

The shell four-ball test was carried out for two or more times in all cases, and the average values of the wear scar diameter were compared. The acceptable reference value for the preliminary examination was 0.23 mm or less.

(Actual Machine Bearing Pattern Durability Test)

In order to verify that a lubricant composition which resulted in less wear in the above-mentioned shell four-ball test exhibits satisfactory bearing wear preventive property even in an actual machine, a bearing pattern durability test using an actual machine differential gear unit was carried out for Example 3, Comparative Example 1, Comparative Example 4, Comparative Example 5, and Reference Example 1.

As the actual machine differential gear unit used in the test, a rear differential gear for FR type passenger cars of a class with a displacement of 2.0 liters to 4.0 liters, for which the preload of the input shaft bearing had been precisely adjusted and recorded, was used. A pattern was created within predetermined ranges of the rotation speed and the torque, and the test was carried out by driving and absorbing with a motor. Regarding the test conditions, an operation pattern of varying the input shaft rotation speed in the range of 0 to 6,000 rotations per minute at an input torque of −150 to 800 Nm was carried out for about 300 hours at an oil temperature in the range of 120° C. to 160° C.

Before the initiation of the test, the rotation torque of the pinion gear shaft including a bearing was checked, and when the rotation torque was maintained at 0.15 Nm or higher even after the test, and there was no rattling caused by wear of the bearing in the thrust direction of the pinion gear shaft, the case was considered acceptable, while in a case in which rattling of 1 μm or more was recognized, the case was evaluated to be unacceptable.

(Differential Part Damage Test)

For Example 3 and Reference Example 1, an actual machine test was carried out in order to evaluate the extreme pressure characteristics (seizure resistance of differential gear unit).

The differential part damage test was carried out by driving a rear differential gear for an FR type commercial vehicle of a class with a displacement of 2.0 liters to 4.0 liters, with a motor by predetermined rotations. Regarding the test conditions, the differential rotation speed of the right and left output shafts was 1,800 rotations per minute, the oil temperature was set to 50° C. to 80° C., the ring gear load torque was increased from 100 Nm to 1,300 Nm at an increment of 50 Nm (10 seconds each time), and thereby evaluation was carried out by checking the presence or absence of the occurrence of damage in the differential gear unit.

(Test Results)

The results of the various tests are presented in Table 1.

(Discussion)

As is obvious from the results shown in Table 1, a GL-5 differential gear oil with a SAE viscosity grade of 85W-90, such as Reference Example 1, has a high absolute viscosity at −40° C. and has high stirring resistance at a low temperature. Thus, fuel-saving characteristics over a wide temperature range may not be achieved. On the other hand, the differential gear oil has sufficient durability, such as that the shell four-ball wear amount is small, and the differential gear oil passes an actual machine bearing pattern durability test and a differential part damage test.

Comparative Examples 1 to 6 for which the SAE viscosity grade was adjusted to 75W-85 in order to suppress stirring resistance for the purpose of improving the fuel-saving characteristics, have large shell four-ball wear amounts and do not satisfy the acceptance criteria of 0.23 mm or less.

Comparative Example 2 is a product obtained using a saturated fatty acid instead of an unsaturated fatty acid, Comparative Example 3 is a product obtained by changing a monooleate or a combination of a monooleate and a dioleate to dioleate only, and Comparative Example 6 is a product obtained by changing the ester base oil from TMP to DIDA. However, the shell four-ball wear amounts increased due to these differences.

In contrast, Examples 1 to 6, which are lubricant compositions of the present invention, have small shell four-ball wear amounts compared to Comparative Examples 1 to 6. Furthermore, Example 3 was selected as a representative example of Examples 1 to 6, and an actual machine bearing pattern durability test and a differential part damage test were carried out. As a result, it was verified that a lubricant composition that has a small wear amount in the shell four-ball test at a high temperature even if the viscosity is low at a low temperature (−40° C.), passes the actual machine bearing pattern durability test, and has excellent extreme pressure characteristics equal to or higher than those of a high-viscosity differential gear oil (Reference Example 1) in the differential part damage test.

TABLE 1

| | | Example 1 | Example 2 | Example 3 | Example 4 | Example 5 | Example 6 | Comparative Example 1 |
|---|---|---|---|---|---|---|---|---|
| (A-1) GTL base oil | 3.8 $mm^2/s$ @ 100° C. mass % | | | | | | | |
| (A-1) GTL base oil | 7.8 $mm^2/s$ @ 100° C. mass % | 56 | 56.5 | 56 | 56.2 | 56 | 56 | 57 |

TABLE 1-continued

| | | | | | | | | |
|---|---|---|---|---|---|---|---|---|
| (A-2) PAO | 3.91 $mm^2/s$ @ 100° C. mass % | | | | | | | |
| (A-2) PAO ethylene-propylene copolymer | 38.6 $mm^2/s$ @ 100° C. mass % | 18 | 18 | 18 | 18 | 18 | 18 | 18 |
| (A-3) Ester base oil TMP | 4.42 $mm^2/s$ @ 100° C. mass % | 10 | 10 | 10 | 10 | 10 | 10 | 10 |
| Ester base oil DIDA | 3.7 $mm^2/s$ @ 100° C. mass % | | | | | | | |
| (B-1) Unsaturated fatty acid | Oleic acid mass % | 1 | 0.5 | | | | | |
| Saturated fatty acid | Stearic acid mass % | | | | | | | |
| (B-2) Partial esterification product of unsaturated fatty acid and higher alcohol | Glycerol monooleate mass % | | | 1 | 0.5 | | | |
| (B-2) | Glycerol dioleate mass % | | | | 0.3 | | | |
| (B-2) | Pentaerythritol monooleate mass % | | | | | 1 | | |
| (B-2) | Trimethylolpropane monooleate mass % | | | | | | 1 | |
| Viscosity index improver | mass % | 5 | 5 | 5 | 5 | 5 | 5 | 5 |
| GL-5 additive package | S—P-based mass % | 10 | 10 | 10 | 10 | 10 | 10 | 10 |
| | Sulfur content mass % | 2.3 | 2.3 | 2.3 | 2.3 | 2.3 | 2.3 | 2.3 |
| | Phosphorus content mass % | 0.13 | 0.13 | 0.13 | 0.13 | 0.13 | 0.13 | 0.13 |
| SAE viscosity grade | | 75W-85 | 75W-85 | 75W-85 | 75W-85 | 75W-85 | 75W-85 | 75W-85 |
| Kinematic viscosity | $mm^2/s$ @ 40° C. | 74.5 | 74.5 | 74.5 | 74.5 | 74.5 | 74.5 | 74.5 |
| | $mm^2/s$ @ 100° C. | 11.9 | 11.9 | 11.9 | 11.9 | 11.9 | 11.9 | 11.9 |
| Viscosity index | | 157 | 157 | 157 | 157 | 157 | 157 | 157 |
| Low-temperature viscosity @ 40° C. | Pa · s | <55 | <55 | <55 | <55 | <55 | <55 | <55 |
| Shell four-ball test Condition 1 [135° C.] | Average wear scar diameter mm | 0.21 | 0.22 | 0.22 | 0.23 | 0.23 | 0.23 | 0.28 |
| Shell four-ball test Condition 2 [160° C.] | Average wear scar diameter mm | 0.21 | 0.23 | 0.22 | 0.23 | 0.23 | 0.23 | 0.27 |
| | | Test for durability on actual vehicle | | | | | | |
| Actual machine bearing pattern durability | Actual machine used: rear differential gear for FR passenger car of class with displacement of 2.0 to 4.0 L<br>Test conditions: composite pattern in the ranges of rotation speed 0 to 6,000 rpm, input torque 150 to 800 Nm, oil temperature 120° C. to 180° C., 300 hours | | | Acceptable | | | | Unacceptable |
| 2. Differential part damage test (damage limit torque) | Actual machine used: rear differential gear for FR commercial vehicle of class with displacement of 2.0 to 4.0 L<br>Test conditions: differential rotation speed 1,800 rpm, load torque 100 to 1,300 Nm (50 Nm interval/10 sec each), oil temperature 50° C. to 80° C., limit torque | | | Acceptable<br>1300 Nm | | | | |

| | | Comparative Example 2 | Comparative Example 3 | Comparative Example 4 | Comparative Example 5 | Comparative Example 6 | Reference Example 1 |
|---|---|---|---|---|---|---|---|
| (A-1) GTL base oil | 3.8 $mm^2/s$ @ 100° C. mass % | | | 40 | | | |
| (A-1) GTL base oil | 7.8 $mm^2/s$ @ 100° C. mass % | 56 | 56 | | | 56.5 | |
| (A-2) PAO | 3.91 $mm^2/s$ @ 100° C. mass % | | | | 40 | | |
| (A-2) PAO ethylene-propylene copolymer | 38.6 $mm^2/s$ @ 100° C. mass % | 18 | 18 | 35 | 35 | 18.5 | |
| (A-3) Ester base oil TMP | 4.42 $mm^2/s$ @ 100° C. mass % | 10 | 10 | 10 | 10 | | |
| Ester base oil DIDA | 3.7 $mm^2/s$ @ 100° C. mass % | | | | | 10 | |
| (B-1) Unsaturated fatty acid | Oleic acid mass % | | | | | | |

TABLE 1-continued

| | | | | | | | |
|---|---|---|---|---|---|---|---|
| Saturated fatty acid | Stearic acid mass % | 1 | | | | | |
| (B-2) Partial esterification product of unsaturated fatty acid and higher alcohol | Glycerol monooleate mass % | | | | | | |
| (B-2) | Glycerol dioleate mass % | | 1 | | | | |
| (B-2) | Pentaerythritol monooleate mass % | | | | | | |
| (B-2) | Trimethylolpropane monooleate mass % | | | | | | |
| Viscosity index improver | mass % | 5 | 5 | 5 | 5 | 5 | |
| GL-5 additive package | S—P-based mass % | 10 | 10 | 10 | 10 | 10 | |
| | Sulfur content mass % | 2.3 | 2.3 | 2.3 | 2.3 | 2.3 | 2.8 |
| | Phosphorus content mass % | 0.13 | 0.13 | 0.13 | 0.13 | 0.13 | 0.13 |
| SAE viscosity grade | | 75W-85 | 75W-85 | 75W-85 | 75W-85 | 75W-85 | 85W-90 |
| Kinematic viscosity | $mm^2/s$ @ 40° C. | 74.5 | 74.5 | 68.7 | 68.5 | 74.6 | 182 |
| | $mm^2/s$ @ 100° C. | 11.9 | 11.9 | 11.7 | 11.7 | 11.8 | 17.2 |
| Viscosity index | | 157 | 157 | 167 | 167 | 156 | 100 |
| Low-temperature viscosity @ 40° C. | Pa · s | <55 | <55 | <35 | <35 | <55 | >150 |
| Shell four-ball test Condition 1 [135° C.] | Average wear scar diameter mm | 0.26 | 0.24 | 0.27 | 0.27 | 0.25 | 0.21 |
| Shell four-ball test Condition 2 [160° C.] | Average wear scar diameter mm | 0.28 | 0.27 | 0.27 | 0.28 | 0.26 | 0.21 |
| | | Test for durability on actual vehicle | | | | | |
| Actual machine bearing pattern durability | Actual machine used: rear differential gear for FR passenger car of class with displacement of 2.0 to 4.0 L Test conditions: composite pattern in the ranges of rotation speed 0 to 6,000 rpm, input torque 150 to 800 Nm, oil temperature 120° C. to 180° C., 300 hours | | | Unacceptable | Unacceptable | | Acceptable |
| 2. Differential part damage test (damage limit torque) | Actual machine used: rear differential gear for FR commercial vehicle of class with displacement of 2.0 to 4.0 L Test conditions: differential rotation speed 1,800 rpm, load torque 100 to 1,300 Nm (50 Nm interval/10 sec each), oil temperature 50° C. to 80° C., limit torque | | | | | | Acceptable 1200 Nm |

What is claimed is:

1. A lubricant composition comprising: (A-1) a Fischer-Tropsch-derived base oil having a kinematic viscosity at 100° C. of 6 to 9 $mm^2/s$; (A-2) a poly-alpha-olefin having a kinematic viscosity at 100° C. of 30 to 50 $mm^2/s$; and (A-3) an ester compound having a kinematic viscosity at 100° C. of 3 to 6 $mm^2/s$, and further comprising (B-1) an unsaturated fatty acid and/or (B-2) a partial ester compound of an unsaturated fatty acid and a polyol, wherein the partial ester compound of an unsaturated fatty acid and a polyol includes a monoester compound of an unsaturated fatty acid and a polyol at a proportion of 50% by mass or more of the total amount of the partial ester compound, and the SAE viscosity grade is 75W-85 or lower, wherein the (B-2) partial ester compound of an unsaturated fatty acid and a polyol is a partial ester of an unsaturated fatty acid and pentaerythritol, a partial ester of an unsaturated fatty acid and trimethylolpropane, or a partial ester of an unsaturated fatty acid and glycerol, or a combination of these esters, wherein the (B-1) unsaturated fatty acid and/or the (B-2) partial ester compound of an unsaturated fatty acid and a polyol at a proportion of 0.2 to 2% by mass in total with respect to the total mass of the composition, wherein the (A-1) Fischer-Tropsch-derived base oil is at a proportion of 50 to 60% by mass with respect to the total mass of the composition, the (A-2) poly-alpha-olefin is at a proportion of 15 to 25% by mass with respect to the total mass of the composition, and the (A-3) ester compound is at a proportion of 8 to 12% by mass with respect to the total mass of the composition, wherein the (A-3) ester compound is an ester compound of trimethylolpropane, a linear carboxylic acid having 8 carbon atoms, and a linear carboxylic acid having 10 carbon atoms, and wherein the unsaturated fatty acid is selected from the group consisting of palmitoleic acid, oleic acid, elaidic acid, gadoleic acid, and eicosenoic acid.

2. The lubricant composition according to claim 1, wherein the lubricant composition is used as an automotive hypoid gear oil.

3. The lubricant composition according to claim 1, wherein the lubricant composition has a kinematic viscosity at 100° C. of 11.0 $mm^2/s$ or higher and lower than 13.5 $mm^2/s$, satisfies the level of GL-5 as the API gear oil type, and has a viscosity index of 155 or higher.

* * * * *